US005115347A

United States Patent [19]

Nilssen

[11] Patent Number: 5,115,347

[45] Date of Patent: May 19, 1992

[54] ELECTRONICALLY POWER-FACTOR-CORRECTED BALLAST

[76] Inventor: Ole K. Nilssen, Caesar Dr., Barrington, Ill. 60010

[21] Appl. No.: 569,639

[22] Filed: Aug. 20, 1990

[51] Int. Cl.[5] ..... H05B 41/24

[52] U.S. Cl. ..... 315/247; 315/906; 315/272

[58] Field of Search ..... 315/247, 251, 272, 206

[56] References Cited

U.S. PATENT DOCUMENTS

| | | | |
|---|---|---|---|
| 4,251,752 | 2/1981 | Stolz | 315/247 |
| 4,277,726 | 7/1981 | Burke | 315/98 |
| 4,277,728 | 7/1981 | Stevens | 315/247 |
| 4,388,561 | 6/1983 | Koshimura et al. | 315/247 |
| 4,538,095 | 8/1985 | Nilssen | 315/244 |

*Primary Examiner*—Eugene R. LaRoche
*Assistant Examiner*—Tan Dinh

[57] ABSTRACT

A fluorescent lamp is connected in parallel with the tank capacitor of a resonant L-C circuit series-excited by a 30 kHz voltage from a self-oscillating inverter. The inverter's DC supply voltage is at certain times obtained directly from unfiltered full-wave-rectified 120 Volt/60 Hz power line voltage and at certain other times from an energy-storing capacitor kept charged to a given voltage level by up-conversion from the unfiltered full-wave-rectified rectified power line voltage. The up-conversion is accomplished via a FET transistor switched at 30 kHz with a gate-drive derived from the L-C circuit. Whenever the magnitude of the DC supply voltage exceeds a predetermined level, the gate-drive voltage ceases to be provided and the up-conversion process ceases. Whenever up-conversion does take place, the magnitude of the current drawn from the power line is proportional to the instantaneous magnitude of the power line voltage. To maximize overall efficiency, while maintaining high power factor, low total harmonic distortion and low lamp current crest factor, the inverter's DC supply voltage is supplied directly from the power line whenever the instantaneous magnitude of the power line voltage exceeds about 120 Volt and via the up-converter in combination with the energy-storing capacitor whenever the instantaneous magnitude of the power line voltage is below 120 Volt.

24 Claims, 3 Drawing Sheets

ELECTRONICALLY POWER-FACTOR-CORRECTED BALLAST

BACKGROUND OF THE INVENTION

1. The present invention relates to power-line-operated power-factor-corrected electronic ballasts for gas discharge lamps, particularly of a type where the current drawn by these ballasts from the power line has a low percentage of total harmonic distortion, while the lamps receive lamp current of relatively low crest factor.

2. Description of Prior Art

There are two predominant types of electronic ballasts for gas discharge lamps: (a) a first type may be referred-to as the parallel-resonant type and involves the use of a current-excited (i.e., parallel-excited) parallel-loaded resonant L-C circuit; and (b) a second type that may be referred-to as the series-resonant type and involves the use of a voltage-excited (i.e., series-excited) parallel-loaded resonant L-C circuit.

An example of the parallel-resonant type of electronic ballasts is described in U.S. Pat. No. 4,277,726 to Burke. An example of the series-resonant type of electronic ballasts is described in U.S. Pat. No. 4,538,095 to Nilssen.

Of these two types of electronic ballasts, the parallel-resonant type is conducive to yielding a stable easy-to-control self-oscillating inverter-type ballast; whereas the series-resonant type, although potentially simpler and more efficient, is harder to control in that it has a natural tendency to self-destruct in case the lamp load be removed and/or in case the phasing between applied voltage and resulting current were to become such that the current be leading.

To mitigate this tendency to self-destruct under no-load and/or special load conditions, various protection circuits have been developed, such as for instance described in U.S. Pat. No. 4,638,395 to Nilssen.

However, in situations where these types of electronic ballasts are powered from the AC voltage on an ordinary electric utility power line, it is important to assure that the current drawn by the ballast from the power line is drawn with a high power factor (preferably at least 90.0%) as well as with a low amount of total harmonic distortion (preferably no higher than 20.0%). Also, it is important that the gas discharge lamp be powered with a lamp current having a relatively low crest factor (preferably no higher than 1.7).

SUMMARY OF THE INVENTION

GENERAL PURPOSE OF PRESENT INVENTION

The general purpose of the present invention is that of providing a method for cost-effectively improving the waveform of the current drawn by an electronic ballast from the power line (to a point where the power factor is at least 90.0% and the total harmonic distortion is no higher than 20.0%) while at the same time maintaining a lamp current crest factor no higher than 1.7, yet minimizing the efficiency-loss and cost-penalties normally associated with such waveform improvement.

OBJECTS OF THE INVENTION

An object of the present invention is the provision of a cost-effective means for improving the waveshape of the current drawn by a power-line-operated electronic ballast.

Another object is that of providing a cost-effective power-factor-corrected electronic ballast drawing current from the power line with acceptably low harmonic distortion while supplying an output current of acceptably low crest factor.

Yet an over-riding object is that of providing a cost-effective high-efficiency electronic ballast with desirable operating characteristics.

These as well as other objects, features and advantages of the present invention will become apparent from the following description and claims.

BRIEF DESCRIPTION

A fluorescent lamp is connected in parallel with the tank capacitor of a resonant L-C circuit series-excited by a 30 kHz voltage from a self-oscillating inverter.

The inverter's DC supply voltage is at certain times obtained directly from unfiltered full-wave-rectified 120 Volt/60 Hz power line voltage and at certain other times from an energy-storing capacitor kept charged to a given voltage level (typically equal to 65–75% of the peak magnitude of the power line voltage, which is about 120 Volt in instant case) by up-conversion from the unfiltered full-wave-rectified rectified power line voltage; which up-conversion is accomplished via a FET transistor switched at 30 kHz with a gate-drive derived from the L-C circuit.

Whenever the magnitude of the DC supply voltage exceeds a certain predetermined level (i.e., 120 Volt in this case), the gate-drive voltage ceases to be provided and the up-conversion action ceases. Whenever up-conversion does take place, the magnitude of the current drawn from the power line (as averaged over a complete cycle of the 30 kHz inverter voltage) is nearly completely proportional to the instantaneous magnitude of the power line voltage.

To maximize overall efficiency, while maintaining high power factor, low total harmonic distortion and low lamp current crest factor, the inverter's DC supply voltage is supplied directly from the power line (i.e., via the unfiltered rectifier output) whenever the instantaneous magnitude of the power line voltage exceeds about 120 Volt and via the up-converter (in combination with the energy-storing capacitor and an associated commutating diode) whenever the instantaneous magnitude of the power line voltage is below 120 Volt.

Thus, in the preferred embodiments of the invention, the up-converter operates only during part of each half-cycle of the 60 Hz power line voltage; and the resulting DC supply voltage will have an instantaneous magnitude that is equal to the larger of: (i) 120 Volt; and (ii) the instantaneous absolute magnitude of the power line voltage.

In a modifification of the preferred embodiment, said certain pre-determined level is set higher than the peak magnitude of the power line voltage (i.e., at about 200 Volt); in which case, as long as the L-C circuit is indeed loaded, up-conversion takes place on a continuous basis; which means that the instantaneous magnitude of the current drawn from the power line (if filtered for 30 kHz ripple) becomes nearly exactly proportional to the instantaneous magnitude of the power line voltage; which, in turn, corresponds to nearly 100% power factor and nearly zero percent harmonic distortion.

DESCRIPTION OF THE PREFERRED EMBODIMENT

Details of Construction

Figure 1:
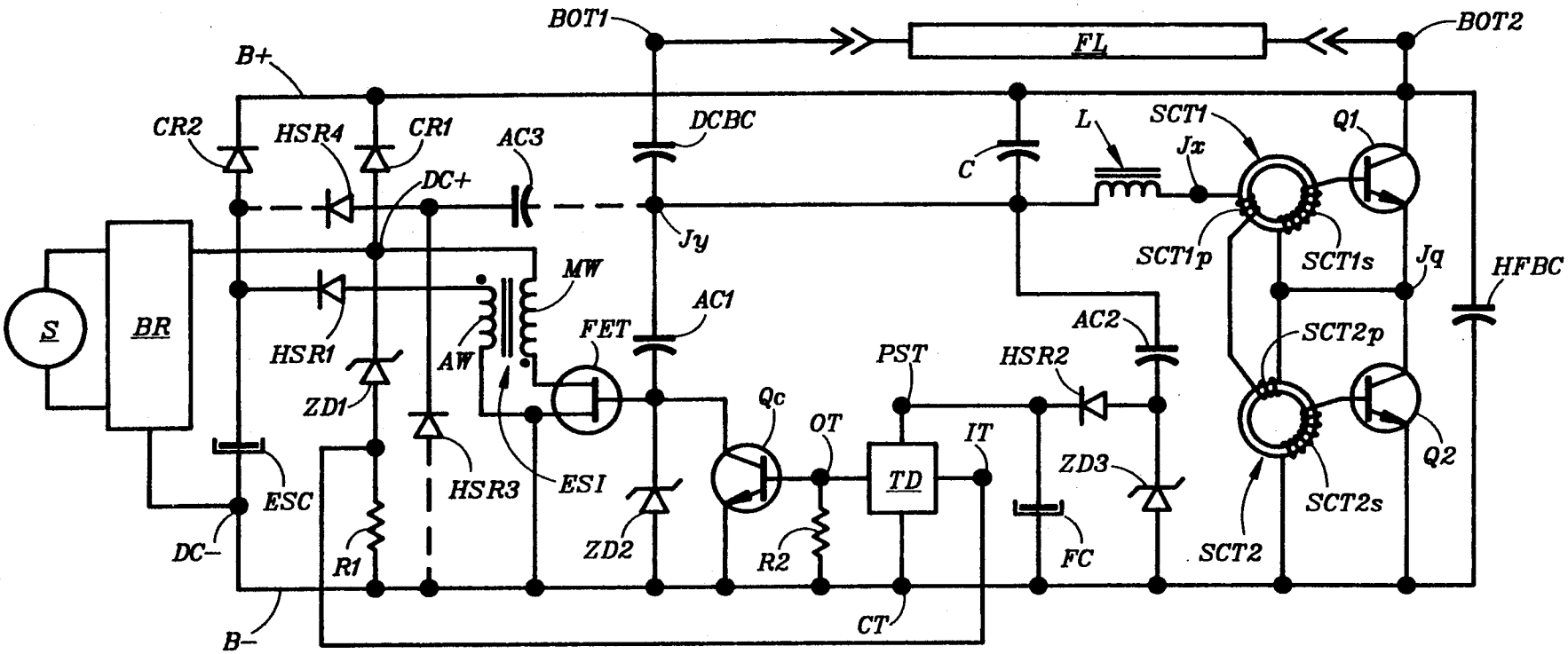
FIG. 1 schematically illustrates the basic circuit arrangement of the invention in its first preferred embodiment.

FIG. 1 schematically illustrates a basic circuit arrangement of the first preferred embodiment of the invention.

In FIG. 1, 120 Volt/60 Hz power line voltage from an ordinary electric utility power line source S is provided to the AC power input terminals of a bridge rectifier BR, the DC output from which is applied between a DC− terminal and a DC+ terminal. The DC− terminal is connected directly with a B− bus; while the DC+ terminal is connected with the anode of a first commutating rectifier CR1, whose cathode is connected with a B+ bus.

Main winding MW of an energy-storing inductor ESI is connected between the DC+ terminal and the drain of field effect transistor FET, whose sink is connected with the B− bus. An auxiliary winding AW, which is tightly coupled to main winding MW on energy-storing inductor ESI, is connected between the B− bus and the anode of a high speed rectifier HSR1, whose cathode is connected with the anode of a second commutating rectifier CR2. The cathode of rectifier CR2 is connected with the B+ bus. An energy-storing capacitor ESC is connected between the B− bus and the anode of rectifier CR2.

A first Zener diode ZD1 is connected with its cathode to the anode of rectifier CR1; while its anode is connected with the B− bus via a resistor R1. A second Zener diode ZD2 is connected with its cathode to the gate of transistor FET and with its anode to the B− bus.

A first transistor Q1 is connected with its collector to the B+ bus and with its emitter to a junction Jq. A second transistor Q2 is connected with its collector to junction Jq and with its emitter to the B− bus. A high-frequency bypass capacitor HFBC is connected between the B− bus and the B+ bus.

The secondary winding SCT1s of a first saturable current transformer SCT1 is connected between the base and the emitter of transistor Q1; and the secondary winding SCT2s of a second saturable current transformer SCT2 is connected between the base and the emitter of transistor Q2.

Primary windings SCT1p and SCT2p of saturable current transformers SCT1 and STC2, respectively, are series-connected between junction Jq and a junction Jx.

A tank inductor L is connected between junction Jx and a junction Jy; and a tank capacitor C is connected between junction Jy and the B+ bus.

The collector of a control transistor Qc is connected with the gate of transistor FET; the emitter of transistor Qc is connected with the B− bus. An output terminal OT of a trigger device TD is connected with the base of transistor Qc; and a resistor R2 is connected between output terminal OT and the B− bus. An input terminal IT of trigger device TD is connected with the anode of Zener diode ZD1. A common terminal CT of trigger device TD is connected with the B− bus; a power supply terminal PST of trigger device TD is connected with the cathode of a high speed rectifier HSR2, whose anode is connected with the cathode of a third Zener diode ZD3. A filter capacitor FC is connected between the cathode of rectifier HSR2 and the B− bus.

An auxiliary capacitor AC1 is connected between junction Jy and the gate of transistor FET; an auxiliary capacitor AC2 is connected between junction Jy and the cathode of Zener diode ZD3; and, optionally, an auxiliary capacitor AC3 is connected between junction Jy and the cathode of a high speed rectifier HSR3, whose anode is connected with the B− bus. The cathode of rectifier HSR3 is connected with the anode of a high speed rectifier HSR4, whose cathode is connected with the anode of rectifier CR2. A DC blocking capacitor DCBC is connected between junction Jy and a ballast output terminal BOT1; a ballast output terminal BOT2 is connected with the B+ bus. A fluorescent lamp FL is connected between ballasts output terminals BOT1 and BOT2.

Figure 2:
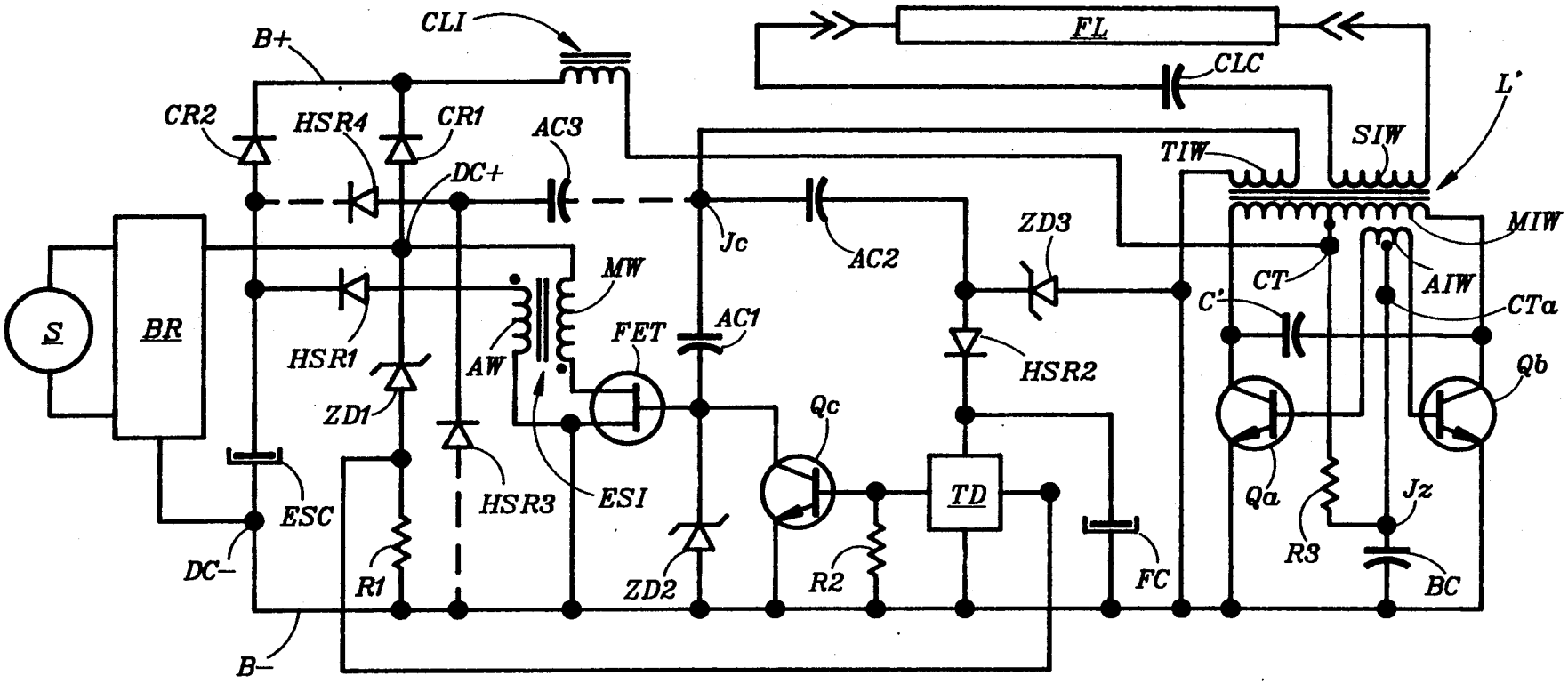
FIG. 2 similarly illustrates the basic circuit arrangement of the invention in its second preferred ambodiment.

FIG. 2 schematically illustrates a basic circuit arrangement of the second preferred embodiment of the invention.

In FIG. 2, each element having the identical identification code as that of an element in FIG. 1 has the same identical function as well. The remaining elements are described and interconnected as follows.

A current-limiting inductor CLI is connected between the B+ bus and a center-tap CT on main inductor winding MIW of tank inductor L'; whose other terminals are connected between the collectors of a first transistor Qa and a second transistor Qb. Tank inductor L' has a secondary inductor winding SIW and a tertiary inductor winding TIW, as well as an auxiliary inductor winding AIW, whose center-tap CTa is connected with a junction Jz and whose other terminals are connected between the bases of transistors Qa and Qb. A tank capacitor C' is connected between the collectors of transistors Qa and Qb. A current-limiting capacitor CLC is connected in series with fluorescent lamp FL to form a series-combination; which series-combination is connected between the terminals of winding SIW. One terminal of winding TIW is connected with the B− bus; while the other terminal is connected with a junction Jc.

A resistor R3 is connected between center-tap CT and junction Jz; and a bias capacitor BC is connected between junction Jz and the B− bus.

EXPLANATION OF WAVEFORMS

Figure 3:
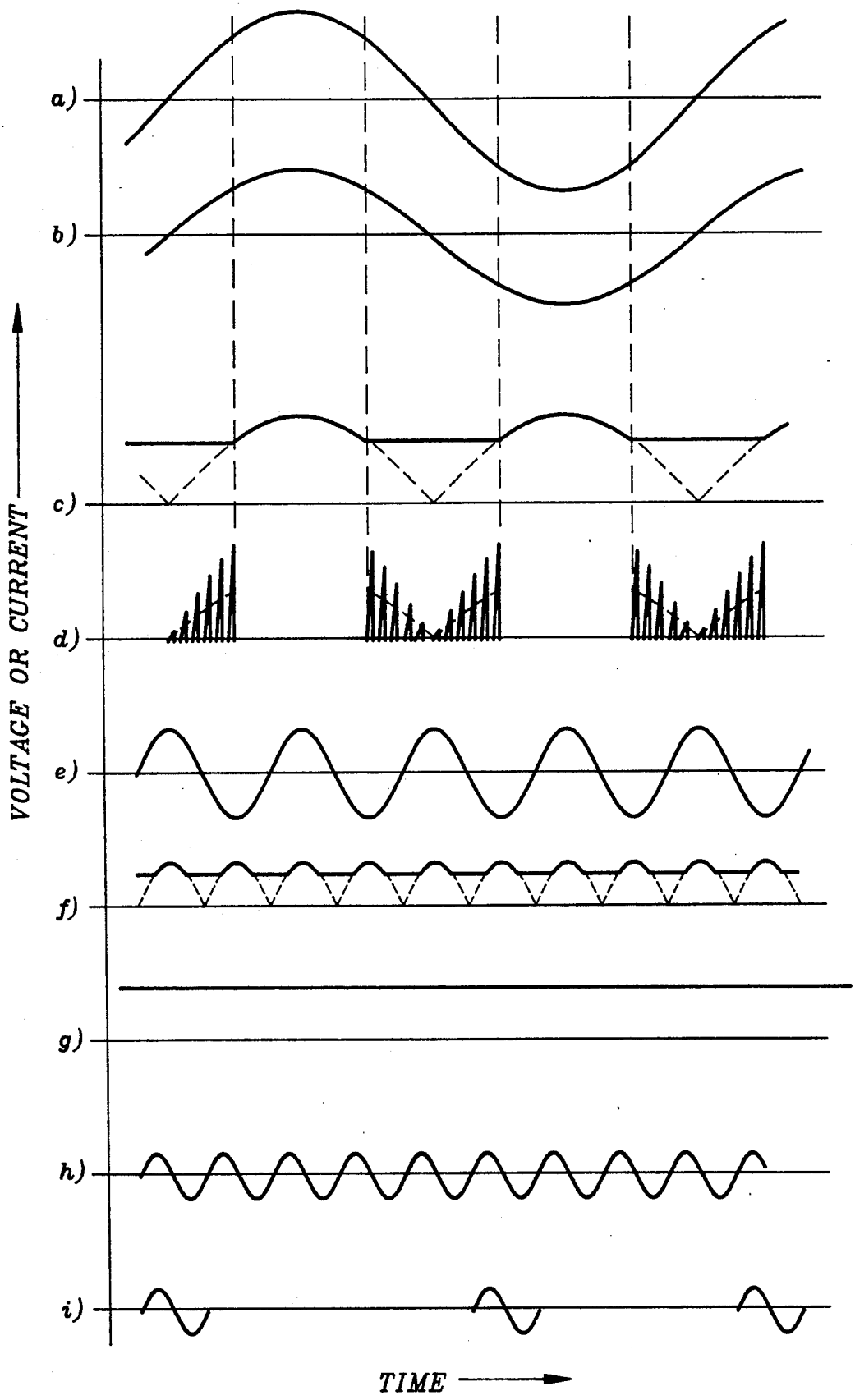
FIG. 3 depicts some of the voltage and current waveforms associated with the two preferred embodiments.

To facilitate explaining the operation of the circuit arrangements of FIGS. 1 and 2, FIG. 3 illustrates the following voltage and current waveforms.

FIG. 3(*a*) shows the sinusoidal waveform of the 120 Volt/60 Hz power line voltage.

FIG. 3(*b*) shows the waveform of the nearly sinusoidal current drawn from the power line by the circuit arrangement of FIG. 1 under a condition of supplying full power to the fluorescent lamp.

FIG. 3(*c*) shows the waveform of the DC voltage present between the B− bus and the B+ bus of the circuit arrangement of FIG. 1 under a condition of supplying full power to the fluorescent lamp.

FIG. 3(*d*) shows details of the current drawn by the up-converter of the circuit arrangement of FIG. 1 under a condition of supplying full power to the fluorescent lamp.

FIGS. 3(*e*) and 3(*f*) are repetitions of FIGS. 3(*a*) and 3(*c*), respectively, except for a different time-scale.

FIG. 3(*g*) shows the substantially constant-magnitude DC supply voltage in a situation where all the power supplied to the inverter circuit is supplied via the up-converter.

FIG. 3(*h*) shows the sinusoidal waveform of the current drawn from the power line in a situation where all the power supplied to the inverter circuit is supplied via the up-converter while at the same time the inverter circuit is fully loaded.

FIG. 3(*i*) shows the intermittently sinusoidal waveform of the current drawn from the power line in a situation where all the power supplied to the inverter circuit is supplied via the up-converter while at the same time the inverter circuit is only partially loaded.

DETAILS OF OPERATION

In the overall circuit arrangement of FIG. 1, the inverter circuit (which consists of the following principal components: HFBC, Q1, Q2, SCT1, SCT2, L and C) is powered from the DC voltage present between the B− bus and the B+ bus; which DC voltage is as illustrated by FIG. 3(*c*).

The operation of the inverter circuit is conventional and is explained in detail in U.S. Pat. No. 4,538,095 to Nissen. As shown, the inverter circuit has to be triggered into operation. However, as is well known, an automatic trigger means can readily be provided.

The inverter circuit's DC supply voltage has an instantaneous absolute magnitude that is the larger of: (i) the instantaneous absolute magnitude of the power line voltage; and (ii) the instantaneous absolute magnitude of the DC voltage present across energy-storing capacitor ESC. That is, whenever the absolute magnitude of the power line voltage is larger than that of the voltage on ESC, commutating rectifier CR1 provides for the rectified power line voltage to be applied between the B− bus and the B+ bus; whereas, whenever the absolute magnitude of the power line voltage is lower than that of the voltage on ESC, commutating rectifier CR2 provides for the ESC voltage to be applied between the B− bus and the B+ bus. Thus, the larger the magnitude of the voltage on ESC, the lower the ripple voltage on the inverter circuit's DC supply voltage.

Eventually, by making the magnitude of the ESC voltage equal-to or larger than the peak absolute magnitude of the power line voltage, assuming the capacitance of ESC to be very large, the ripple voltage will substantially disappear, and the inverter circuit's DC supply voltage will be as depicted in FIG. 3(*g*).

The energy stored by energy-storing capacitor ESC must have been supplied to ESC by way of the up-converter, which consists of principal elements HSR1, ESI, FET, ZD2 and AC1. The operation of the up-converter is controlled by the ON/OFF control means consisting of principal elements ZD1, R1, TD and Qc; which ON/OFF control means is powered from an auxiliary DC power supply consisting of principal elements AC2, ZD3, HSR2 and FC.

The magnitude of the DC voltage developing across energy-storing capacitor ESC depends on two main factors: (i) the amount of energy being delivered to ESC by the up-converter; and (ii) the amount of energy being drawn from ESC by the inverter circuit. The higher the magnitude of the DC voltage on ESC, the less energy is drawn by the inverter circuit directly from the power line; and, as a result, the more energy is drawn by the inverter from energy-storing capacitor ESC. That is, the higher the ripple voltage on the inverter circuit's DC supply voltage, the more energy is drawn directly from the power line and the less energy is drawn via the up-converter.

In the preferred embodiment, the magnitude of the DC voltage on ESC is arranged to be about 120 Volt. Thus, whenever the instantaneous absolute magnitude of the 120 Volt/60 Hz power line voltage exceeds about 120 Volt, power is delivered to the inverter circuit directly from the power line (i.e., directly from the unfiltered DC output of bridge rectifier BR); whereas whenever the instantaneous absolute magnitude of the 120 Volt/60 Hz power line voltage is below about 120 Volt, power to the inverter circuit is delivered from energy-storing capacitor ESC.

The magnitude of the DC voltage on capacitor ESC is established and maintained at about 120 Volt via Zener diode ZD1; which Zener diode has a Zenering voltage of about 120 Volt.

Thus, as soon as the instantaneous absolute magnitude of the power line voltage exceeds about 120 Volt, current will start flowing through Zener diode ZD1; thereby giving rise to a voltage across resistor R1; which voltage, in turn, is applied to the input of Schmitt-type trigger device TD. As soon as the input voltage to trigger device TD exceeds about 3.0 Volt, this trigger device will provide an output operative to cause transistor Qc to become conductive; which, in turn, causes the gate of transistor FET to become short-circuited to its source; thereby, in turn, causing the up-converter action to cease; thereby, in turn, stopping the charging of capacitor ESC.

In other words, as indicated in FIG. 3(*d*), the up-converter will operate intermittently: it will operate whenever the instantaneous absolute magnitude of the power line voltage is lower than about 120 Volt; but it will not operate during periods when the instantaneous absolute magnitude of the power line is higher than about 120 Volt. As a result, the current drawn from the power line by the circuit arrangement of FIG. 1 will consist of two separate parts: (i) a first part occurring whenever the instantaneous absolute magnitude of the power line voltage is below about 120 Volt and during which the instantaneous magnitude of the current drawn is entirely proportional to the instantaneous magnitude of the power line voltage; and (ii) a second part occurring whenever the instantaneous magnitude of the power line voltage is above about 120 Volt and during which the instantaneous magnitude of the current drawn is determined by the voltage-versus-current characteristics of the inverter circuit (which, for the inverter circuit of FIG. 1, are such as to cause the current to have a magnitude that increases somewhat less than proportionally with the magnitude of the voltage).

The power to operate the ON/OFF control means is obtained by way of capacitor AC2, whose capacitance is small compared with that of tank capacitor C. Since the magnitude of the 30 kHz voltage at junction Jy is very high, capacitor AC2 delivers a substantially constant 30 kHz current to the cathode of Zener diode ZD3; which 30 kHz current is rectified by this 10 Volt Zener diode, thereby to establish across it a series of positive squarewave voltage pulses; which squarewave voltage pulses are applied to filter capacitor FC via high speed rectifier HSR2, thereby to establish a constant-magnitude DC voltage of about 10 Volt at power supply terminal PST of trigger device TD.

Transistor FET is driven by 30 kHz current supplied from junction Jy via capacitor AC1, whose capacitance value is small compared with that of tank capacitor C. This 30 kHz current is rectified and magnitude-limited by 10 Volt Zener diode ZD2; thereby providing a series of 30 kHz positive squarewave voltage pulses at the gate of transistor FET; which positive 10 Volt pulses, in turn, cause transistor FET to switch ON and OFF at a 30 kHz rate and with an approximately 50% duty-cycle.

However, whenever output from trigger device TD causes transistor Qc to become conductive, the voltage pulses at the gate of transistor FET are short-circuited, thereby stopping the ON/OFF switching action of transistor FET.

Each time transistor FET is conductive, current starts building in main winding MW of energy-storing inductor ESI. At any given mment in time, the magnitude of this current grows at a rate proportional to the magnitude of the voltage present at the DC+ terminal and for a length of time determined by the duration of the ON-time of transistor FET. Since the duration of this ON-time is substantially constant, the magnitude to which the current through main winding MW grows will be directly proportional to the magnitude of the DC voltage at the DC+ terminal. Hence, the magnitude of the current drawn from the power line by the up-converter—as averaged over a complete cycle of the 30 kHz conversion frequency—will be directly proportional to the magnitude of the power line voltage; which, in turn, means that: (i) the power factor at which power line current is drawn by the up-converter will be substantially equal to 100%; and (ii) the corresponding harmonic distortion of this power line current will be substantially equal to zero.

In addition to being proportional to the magnitude of the power line voltage, the magnitude of the current drawn from the power line by the up-converter is also inversely proportional to the inductance represented by main winding MW.

As indicated by FIG. 3(*d*), if the operation of the up-converter is disabled for some period during each half-cycle of the 120 Volt/60 Hz power line voltage, the resulting power factor of the current drawn by the up-converter will be well below 100%. Yet, if the up-converter is arranged to cease operation at the very point at which the instantaneous absolute magnitude of the power line voltage exceeds the magnitude of the DC voltage on capacitor ESC, the total net current drawn from the power line can never-the-less be arranged to be nearly sinusoidal, as indicated by FIG. 3(*b*).

In other words, if the up-converter is so arranged as to stop drawing current from the power line at the very same time as the inverter circuit starts drawing current directly from the DC+ terminal, the power line current can indeed be arranged to be nearly sinusoidal. However, for this to be the case, it is necessary that the magnitude of the power line current drawn by the up-converter is made to be about equal to the magnitude of the current drawn directly from the DC+ terminal by the inverter circuit at the very point where the up-conversion stops.

To actually accomplish this feature, it necessary to include the optional function served by elements AC3, HSR3 and HSR4; which function is that of providing a degree of charging to energy-storing capacitor ESC even during periods when the up-converter is disabled. Without this added degree of charging of capacitor ESC, it would be impossible to closely match the magnitude of the power line current drawn by the up-converter with that of the power line current resulting from the current drawn directly from the DC+ terminal by the inverter circuit. This would be so for the basic reason that the power drawn by the inverter circuit from its DC supply voltage is substantially constant during the complete cycle of the power line voltage; whereas, in order to attain the desired high power factor, it is necessary to draw a highly modulated amount of power from the power line—with the amount of power drawn during periods when the instantaneous absolute magnitude of the power line voltage is relatively low being very much lower than it be during periods when the instantaneous absolute magnitude is relatively high.

That is, without providing the added charge to capacitor ESC, the magnitude of the current drawn from the power line by the up-converter would be so high that—at the moment of transistion from up-conversion to direct power supply—the instantaneous magnitude of the net current drawn from the total power line would have to drop substantially, thereby giving rise to a less-than-desirable power factor.

In other words, to make the current drawn from the power line nearly sinusoidal, it is necessary to meet two conditions: (i) a first condition being that of stopping operation of the up-converter at the very moment the instantaneous absolute magnitude of the power line voltage exceeds that of the voltage on capacitor ESC; and (ii) a second condition being for the magnitude of the current drawn by the up-converter to be, at the moment the up-converter ceases to operate, substantially equal to that of the current drawn by the inverter circuit directly from the DC+ terminal; which second condition can readily be accomplished by correspondingly sizing auxiliary capacitor AC3.

The current waveform of FIG. 3(*b*) actually consists of two parts: (i) a first part resulting from the current drawn by the up-converter whenever the instantaneous absolute magnitude of the power line voltage is lower than about 120 Volt; and (ii) a second part resulting from the current drawn by the inverter circuit directly from the unfiltered DC output of bridge rectifier BR whenever the instantaneous absolute magnitude of the power line voltage is larger than about 120 Volt.

For each half-cycle of the 120 Volt/60 Hz power line voltage, the second part prevails between 90 degrees and 135 degrees (i.e., for about about 50% of each half-cycle); whereas the first part prevails during the remainder of each half-cycle.

By changing the Zener diode ZD1 to have a Zener-ing voltage of about 200 Volt, the magnitude of the DC voltage on capacitor ESC will increase to about 200 Volt; and the DC voltage presented to the inverter circuit will therefore be of substantially constant magnitude—as indicated in FIG. 3(*g*). Thus, with a Zener voltage of about 200 Volt, the magnitude of the DC voltage between the B− bus and the B+ bus will be so high that no current will ever flow thereto directly from the unfiltered output of bridge rectifier BR.

If the amount of energy delivered by the up-converter to energy-storing capacitor ESC per half-cycle of the power line voltage is higher than the amount of energy drawn by the inverter circuit from capacitor ESC per such half-cycle, the magnitude of the DC voltage on capacitor ESC will increase. However, it will only increase slightly past the point at which Zener diode ZD1 starts to conduct in that, as soon as enough current flows through Zener diode ZD1 to cause the magnitude of the voltage at input terminal IT of trigger device TD to reach its trigger point of about 3.0 Volt. At that point, the up-converter gets switched OFF; thereby ceasing to provide energy to energy-storing capacitor ESC.

With no energy supplied, the magnitude of the DC voltage on capacitor ESC will start decreasing—with the rate of decrease being proportional to the power drawn by the inverter circuit. However, after having decreased to the point where current ceases to flow through Zener diode ZD1, the magnitude of the voltage provided at input terminal IT of trigger device TD will have fallen to a level low enough to cause the up-converter to become re-activated. Thereafter, as indicated by FIG. 3(*i*), the indicated charge and discharge cycles will be repeated with the repetition period being determined by the amount of power drawn by the inverter circuit: the higher this power draw, the more frequently the charging cycle will occur. Eventually, with sufficiently heavy loading of the inverter circuit, the up-converter will be running on a continuous basis. Of course, if the inverter circuit were to be totally unloaded, it would draw nearly no power and the charging cycle would occur only once in a while: just frequently enough to replenish the little energy consumed by an idling inverter circuit.

The operation of the circuit arrangement of FIG. 2 is basically the same as that of FIG. 1 with respect to the up-converter. The inverter circuit of FIG. 2, however, operates quite differently: its operation being explained in U.S. Pat. No. 4,277,726 to Burke.

Whereas the inverter circuit of FIG. 1 is of the so-called series-resonant type and therefore requires a special control arrangement (not shown) in order to prevent run-away operation and possible self-destruction in case of being left unloaded (as would occur if fluorescent lamp FL were to be disconnected), the inverter circuit of FIG. 2 is of the so-called parallel-resonant type and therefore does not require a special control arrangement to prevent run-away operation.

In FIG. 2, a substantially sinusoidal voltage is generated across the windings of tank inductor L', such as across tertiary inductor winding TIW. The number of turns on this winding has been chosen such that the magnitude of the 30 kHz voltage provided from this winding is such as to cause energy-storing capacitor ESC to be charged only when the magnitude of the inverter circuit's DC supply voltage is higher than that of the DC voltage across capacitor ESC. Thus, whenever the inverter circuit is powered from the voltage on capacitor ESC, no charging of capacitor ESC takes place via auxiliary capacitor AC3, thereby preventing unnecessary circulation (and therefore waste) of energy.

In other words, capacitor ESC is being charged substantially all the time: (i) via the up-converter during times when the instantaneous absolute magnitude of the power line voltage is lower than that of the DC voltage on capacitor ESC; and (ii) via the inverter circuit (and capacitor AC3) during times when the instantaneous absolute magnitude of the power line voltage is higher than that of the DC voltage on capacitor ESC. However, whenever capacitor ESC is being charged via the up-converter, it is not being charged via the inverter circuit, and vice versa.

ADDITIONAL COMMENTS (a) Trigger device TD may be an ordinary Schmitt trigger, similar to Motorola CMOS 14584B.

(b) In the circuit arrangement of FIG. 2, efficiency may be somewhat improved by driving transistor FET, as well as powering trigger device TD, from a winding separate from, and having fewer turns than, tertiary inductor winding TIW—or from a tap on winding TIW.

(c) By having the up-converter operate only about 50% of the time, while powering the inverter circuit directly from the power line at other times, efficiency is substantially improved versus a situation where the inverter circuit is powered via the up-converter all the time. Moreover, the ratings of transistor FET and energy-storing inductor ESI may then be lower than they otherwise would have had to be.

(d) The series-resonant-type inverter circuit of FIG. 1, as well as the parallel-resonant-type inverter circuit of FIG. 2, are both self-oscillating; which means that they oscillate via internal positive feedback, without requiring a separate inverter drive means. Thus, the up-converter operates as a so-called slave of the inverter circuit.

(e) It is believed that the present invention and its several attendant advantages and features will be understood from the preceeding description. However, without departing from the spirit of the invention, changes may be made in its form and in the contruction and interrelationships of its component parts, the form herein presented merely being the presently preferred embodiment.

I claim:

1. An arrangement comprising:

inverter circuit means connected with a set of DC supply terminals;

rectifier means connected with an AC power line voltage and operative to provide a first DC voltage at a rectifier output means; the instantaneous absolute magnitude of the first DC voltage being substantially equal to the of the AC power line voltage;

converter means connected with the rectifier output means and operative to charge an energy-storing capacitor means; there existing a second DC voltage across the energy-storing capacitor means; and commutation means connected in circuit with the rectifier output means, the energy-storing capacitor means, and the inverter circuit means; the commutation means being operative to cause a DC supply voltage to be provided to the DC supply terminals; the instantaneous absolute magnitude of the DC supply voltage being the larger of: (i) the instantaneous absolute magnitude of the first DC voltage; and (ii) the instantaneous absolute magnitude of the second DC voltage.

2. The arrangement of claim 1 wherein the converter means is operative to charge the energy-storing capacitor means only during a fraction of each half-cycle of the AC power line voltage.

3. The arrangement of claim 2 wherein said fraction is larger than one third but smaller than three fourths.

4. The arrangement of claim 1 wherein the instantaneous absolute magnitude of the second DC voltage is maintained at a level substantially lower than the peak absolute magnitude of the AC power line voltage.

5. The arrangement of claim 1 wherein the converter means includes a sensing and control means operative: (i) to sense the magnitude of the second DC voltage; and (ii) to render the converter means inoperative in case the magnitude of the second DC voltage were to exceed a first predetermined level.

6. The arrangement of claim 5 wherein the sensing and control means is additionally operative to re-start operation of the converter means whenever the magnitude of the second DC voltage falls below a second predetermined level; the second predetermined level being lower than said first predetermined level.

7. The arrangement of claim 1 wherein the energy-storing capacitor means is also charged with a current derived from the inverter means by way of a rectifier means.

8. The arrangement of claim 1 wherein the inverter circuit is operative to provide an output of high frequency current at a set of output terminals; the fundamental frequency of the high frequency current being substantially higher than that of the AC power line voltage.

9. The arrangement of claim 1 wherein: (i) the inverter circuit has a set of output terminals; and (ii) a gas discharge lamp is connected in circuit with these output terminals.

10. An arrangement comprising:

a source operative to provide an AC power line voltage at a pair of power line terminals;

rectifier means connected with the power line terminals and operative to provide a first unidirectional current to a first pair of DC terminals; a first DC voltage being present between the first pair of DC terminals; the first DC voltage having a first DC magnitude;

converter means connected with the first pair of DC terminals and operative to provide a second unidirectional current to a second pair of DC terminals; a second DC voltage being present between the second pair of DC terminals; the second DC voltage having a second DC magnitude;

energy-storing capacitor means connected with the second pair of DC terminals;

inverter circuit means having a third pair of DC terminals and being operative, when being supplied with a third DC voltage between the third pair of DC terminals, to provide a high frequency voltage at a first set of output terminals; and commutation means connected in circuit between the the three pairs of DC terminals and operative to cause the instantaneous magnitude of the third DC voltage to be the larger of the first DC magnitude and the second DC magnitude.

11. The arrangement of claim 10 wherein: (i) the second DC magnitude is substantially constant; (ii) the instantaneous absolute value of the first DC magnitude is substantially equal to the instantaneous absolute magnitude of the AC power line voltage; and (iii) the absolute peak magnitude of the AC power line voltage is larger than the absolute value of the second DC magnitude.

12. The arrangement of claim 11 wherein: (i) an additional unidirectional current is provided to the second pair of DC terminals; and (ii) this additional unidirectional current is derived, via high frequency rectifier means, from the high frequency voltage provided by the inverter circuit.

13. The arrangement of claim 12 wherein: (i) there are certain periods during which the second unidirectional current is not being provided; and (ii) the additional unidirectional current is being provided during said certain periods.

14. The arrangement of claim 12 wherein the additional current is being provided only during a part of the complete duration of each half-cycle of the AC power line voltage.

15. The arrangement of claim 10 wherein the second unidirectional current is provided only during a fraction of the total duration of each half-cycle of the AC power line voltage.

16. The arrangement of claim 15 wherein said fraction is larger than about one fifth but smaller than about four fifths.

17. The arrangement of claim 10 wherein the converter means includes control means operative to sense the second DC magnitude and to prevent the second unidirectional current from being provided in case this second DC magnitude were to exceed a predetermined level.

18. The arrangement of claim 10 wherein the converter means includes: (i) energy-storing inductor means; and (ii) transistor means that is switched ON and OFF by way of a signal derived from said high frequency voltage.

19. The arrangement of claim 10 wherein the inverter circuit is self-oscillating by way of positive feedback, thereby not requiring a separate inverter drive means.

20. An arrangement comprising:

a source operative to provide an AC power line voltage at a pair of power line terminals;

rectifier means connected with the power line terminals and operative to provide a first unidirectional current to a first pair of DC terminals; a first DC voltage being present between the first pair of DC terminals; the first DC voltage having a first DC magnitude;

converter means connected with the first pair of DC terminals and operative to provide a second unidirectional current to a second pair of DC terminals; an energy-storing capacitor means being connected between the second pair of DC terminals; a second DC voltage being present between the second pair of DC terminals; the second DC voltage having a second DC magnitude;

inverter circuit means having a third pair of DC terminals and being operative, when being supplied with a third unidirectional current at this third pair of DC terminals, to provide a high frequency voltage at a first set of output terminals; a third DC voltage being present between the third pair of DC terminals; the third DC voltage having a third DC magnitude; and commutation means connected in circuit between the three pairs of DC terminals and operative to supply, from the first and second pairs of DC terminals, the third unidirectional current to the third pair of DC terminals.

21. The arrangement of claim 20 wherein: (i) the second DC magnitude is substantially constant; and (ii) the first DC magnitude has an instantaneous absolute magnitude that is about equal to that of the AC power line voltage.

22. The arrangement of claim 21 wherein the absolute value of the second DC magnitude is lower than the absolute value of the peak magnitude of the AC power line voltage.

23. The arrangement of claim 20 wherein an additional unidirectional current is provided to the second pair of DC terminals; the additional unidirectional current being derived from the high frequency voltage by way of a high frequency rectifier means connected with the set of output terminals.

24. The arrangement of claim 20 wherein: (i) the inverter means is self-oscillating via internal positive feedback; and (ii) the converter means includes a transistor switched ON and OFF by a signal derived from the inverter means.

* * * * *